US006945305B1

(12) United States Patent
Limauro

(10) Patent No.: US 6,945,305 B1
(45) Date of Patent: Sep. 20, 2005

(54) SCREEN FRAME REINFORCEMENT

(76) Inventor: Argeo E. Limauro, 1403 High Ridge Rd., Lake Worth, FL (US) 33461

( * ) Notice: Subject to any disclaimer, the term of this patent is extended or adjusted under 35 U.S.C. 154(b) by 8 days.

(21) Appl. No.: 10/875,764

(22) Filed: Jun. 25, 2004

(51) Int. Cl.[7] ..... A47H 13/00
(52) U.S. Cl. ..... 160/369; 160/395
(58) Field of Search ..... 160/369, 371, 160/380, 395, 405, 391, 392; 52/222

(56) References Cited

U.S. PATENT DOCUMENTS

| | | | | |
|---|---|---|---|---|
| 1,350,027 | A | 8/1920 | Lane | |
| 1,758,720 | A | 5/1930 | Sodergren | |
| 2,335,361 | A | 11/1943 | Schiller | |
| 2,436,277 | A | 2/1948 | Willett | |
| 2,627,311 | A * | 2/1953 | Kaufmann | 160/395 |
| 2,709,489 | A | 5/1955 | Keebler | |
| 2,784,781 | A | 3/1957 | Rhoades | |
| 3,143,165 | A * | 8/1964 | Lewis et. al. | 160/394 |
| 3,220,469 | A | 11/1965 | Oehmig | |
| 3,379,237 | A | 4/1968 | Worthington | |
| 3,696,857 | A | 10/1972 | Le Tarte | |
| 3,729,045 | A | 4/1973 | MacDonald | |
| 4,084,360 | A | 4/1978 | Reckson | |
| 4,472,862 | A | 9/1984 | Bloomfield et al. | |
| 4,603,724 | A | 8/1986 | Borwick | |
| 4,631,882 | A | 12/1986 | Sease | |
| 4,662,038 | A | 5/1987 | Walker | |
| 4,690,192 | A * | 9/1987 | Stilling | 160/57 |
| 4,899,797 | A * | 2/1990 | Green | 160/395 |
| 5,046,546 | A * | 9/1991 | Benedyk et al. | 160/371 |
| 5,209,029 | A * | 5/1993 | Foerst | 52/63 |
| 5,301,737 | A | 4/1994 | Martin | |
| 5,613,544 | A * | 3/1997 | Schaefer | 160/395 |
| 5,921,051 | A | 7/1999 | Hope | |
| 5,960,605 | A | 10/1999 | Hope | |
| 6,499,527 | B1 * | 12/2002 | Lindley, Jr. | 160/28 |
| 2003/0196770 | A1 | 10/2003 | Wylie | |

FOREIGN PATENT DOCUMENTS

| | | |
|---|---|---|
| JP | 8052855 | 2/1996 |

* cited by examiner

*Primary Examiner*—David Purol
(74) *Attorney, Agent, or Firm*—Richard C. Litman

(57) ABSTRACT

The screen frame reinforcement is an elongated plate or strip of rigid material that is attached over a conventional screen frame member to reinforce the splines so that the screen will remain firmly within the spline recess. The plate has a pair of elongated ridges extending the length of the plate adjacent the side edges and are spaced so that the ridges can extend into the spline receiving grooves to bear against the spines. The plate has a V-shaped groove defined along its center line and is frangible so that only half the plate can be used to secure a single screen edge at corners or terminal edges of the screen. The plate may have an anodized finish.

15 Claims, 5 Drawing Sheets

SCREEN FRAME REINFORCEMENT

BACKGROUND OF THE INVENTION

1. Field of the Invention

The present invention relates to a screen frame reinforcement plate which fits over conventional screen framing to provide an additional clamping force to the spline and thus further secures screen material to a conventional screen frame.

2. Description of the Related Art

Conventional screen framing, often used to screen in patios and outdoor pools, usually uses two-inch by two-inch square aluminum tubing with peripheral recesses adapted to receive a peripheral edge of the screen material and a rubber or plastic spline. The edge of screen material is secured to the framing by placing the edge of the screen material into a recess and then forcing the spline into the recess to clamp the screen material in place. This arrangement, however, requires a continuous replacement of the screening and the splines, as environmental and weather conditions cause the screen and splines to become rigid and loose over time. Thus, a cost efficient reinforcement mechanism that will prevent the necessity of continuous replacement of the screening and splines in screen framing is desired.

Various complex screen frames for screen doors and windows have been developed, but the present inventor is not aware on any clamping devices used to reinforce the conventional spline screen retainer—tubular framing method of constructing screened structures.

U.S. Pat. No. 3,220,469, issued Aug. 28, 1963 to R. Oehmig, describes a frame for screen material with two parts that snap together to clamp the edge of the screen material in place. In a first embodiment, the top section includes an integral splined head. In a second embodiment, a separate spline is included which is not contacted by the top part. U.S. Pat. No. 4,603,724, issued Aug. 5, 1986 to M. Borwick, discloses a screened pet door. The screen section of the pet door is held to the frame of the door with a resilient strip. The screen surrounding the outside frame of the pet door is held to the outside frame with a screwed on L-shaped male frame member. The outside frame does not utilize a resilient strip to help hold in the surrounding screen. U.S. Pat. No. 1,350,027, issued Aug. 17, 1920 to A. M. Lane, discloses a metal window screen frame that clamps the edge of a screen material in place. In one embodiment it uses a locking bar to clamp in the wire cloth.

Some screen framing devices disclose unique frame and spline arrangements. U.S. Pat. No. 3,696,857, issued Oct. 10, 1972 to F. Le Tarte, discloses a frame with using zigzagged plastic strip to hold the edge of a screen material into a frame member. U.S. Pat. No. 4,084,360, issued Apr. 18, 1978 to H. Reckson, discloses a unique spline groove that may receive either flat or round splines therein for retaining the screen material. Japanese Patent No. 8-52,855, published Feb. 27, 1996, discloses screen frame where the screen is held to the frame by a series of two splines in two concentric grooves. None of these references teach the use of a reinforcing member.

Some screen framing devices connect a part of the screen to a part of the frame apparatus. U.S. Pat. No. 2,335,361, issued Nov. 4, 1942 to M. B. Schiller, discloses a metal window sash where the edge of a screen material is attached to a clincher strip, which is then secured in the sash body. U.S. Pat. No. 2,436,277, issued May 4, 1945 to L. E. Willett, discloses a similar protective screen where the edge of the screen material is interlocked with an internal flange of a frame before the frame is closed.

Many screen holding devices do not utilize a spline, but instead rely the force of a clamping device to retain the edge of screen material. U.S. Pat. No. 5,301,737, issued Apr. 12, 1994 to W. Martin, discloses a complex two-member clamping device for a screen material that includes a complex series of grooves and ridges. U.S. Pat. No. 1,758,720, issued Jan. 14, 1929 to J. E. Sodergren; U.S. Pat. No. 2,709,489, issued Mar. 16, 1953 to P. T. Keebler; U.S. Pat. No. 2,784,781, issued Jun. 23, 1953 to J. S. Rhoades; U.S. Pat. No. 3,379,237, issued October 1965 to H. M. Worthington; and U.S. Pat. No. 3,729,045, issued Apr. 24, 1973 to R. D. MacDonald, all teach less complex screen clamping devices that do not include the use of a spline.

There are many clamping devices for thin films that do not utilize a spline. U.S. Pat. No. 4,662,038, issued May 5, 1987 to D. Walker, discloses a clip fixing for retaining thin films. U.S. Pat. No. 4,472,862, issued Sep. 25, 1984 to Bloomfield et al., discloses a film fastener for flexible sheets. U.S. Pat. No. 4,631,882, issued Dec. 30, 1986 to Sease, discloses a strip for mounting a flexible covering onto a support surface.

Methods of producing or reinforcing screen frame corners are shown in U.S. Pat. No. 5,921,051, issued Jul. 13, 1999 to R. Hope; U.S. Pat. No. 5,960,605, issued Oct. 5, 1999, also to R. Hope; and U.S. Patent Publication No. 2003/0196770, published Oct. 23, 2003.

None of the above inventions and patents, taken either singly or in combination, is seen to describe the instant invention as claimed. Thus, a screen frame reinforcement solving the aforementioned problems is desired.

SUMMARY OF THE INVENTION

The screen frame reinforcement of the present invention is a plate or elongated strip that is attached over a conventional screen frame member to reinforce the splines so that the screen is firmly retained within the spline recess. The plate is about two inches wide with a substantially uniform cross-sectional shape. The plate has a substantially planar upper surface, a lower surface with two elongated linear ridges extending parallel to the lateral edges of the plate, and an elongated central V-shaped groove that bisects the plate longitudinally. Predrilled holes are formed though the plate at spaced intervals to accommodate screws, which are used to attach the plate to the screen frame with the ridges bearing against the splines. The plate is preferably made from extruded aluminum. The central V-shaped groove allows for the reinforcement member to be separated into two halves for application to screen frames members only holding one screen edge.

Accordingly, it is a principal object of the invention to provide a screen frame reinforcement member that provides an additional clamping force to a spline to keep a screen edge in place in a spline-receiving groove.

It is another object of the invention to provide a screen frame reinforcement member that can be easily separated into two halves for installation on areas of a conventional screen frame where only one side of the frame member has a screen edge secured to the frame member.

It is a further object of the invention to provide a screen frame reinforcement member that can be easily attached to a conventional screen frame by screws.

Still another object of the invention is to provide a screen frame reinforcement member that can be used to redecorate an existing conventional screen frame.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
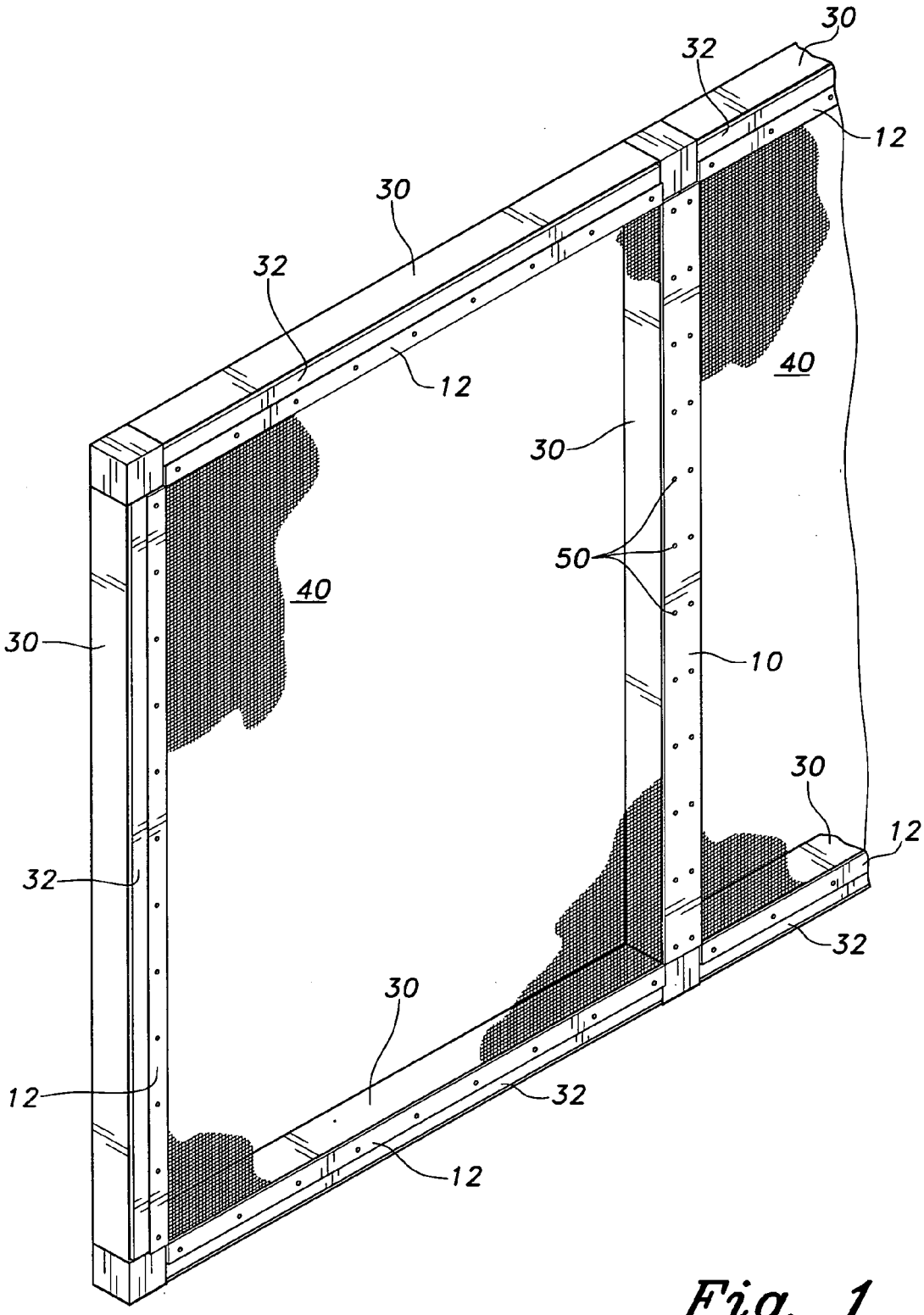
FIG. 1 is an environmental, perspective view of the screen frame reinforcement according to the present invention installed on a conventional screen frame.

The present invention is a screen frame reinforcement member, designated generally as 10 in the drawings. As shown in FIG. 1, the reinforcement member 10 is designed to fit over a conventional screen frame member 30 to reinforce the attachment of a screen 40 to the frame member 30. Conventional screen frame members 30 are often used to screen in outdoor swimming pools or patios. The screen 40 is attached to one or both sides of the two-inch by two-inch square tubular aluminum frame member 30. The attachment or outer face 32 of the frame member 30 is usually on the outside of the screened-in area. A reinforcement member 10 may be split longitudinally into two half-reinforcement members 12 for reinforcement of the screen 40 where only one screen edge is attached to the frame 30, such as frame members 30 that abut the ground or form a corner of a building or other structure. Self-taping screws 50 are used to attach a reinforcement member 10 or a half reinforcement member 12 to the attachment face 32 of a frame member 30.

Frame members 30 usually have an anodized bronze outer surface coloring. The reinforcement members 10 may be provided with an anodized finish for protection from corrosion, and may have an anodized bronze color, or any other decorative color in order to satisfy the aesthetic taste of a consumer. The screen frame reinforcement members 10 may thus provide a means of reinforcing old conventional screen frames and a means to apply a new decorative appearance to an existing conventional screen frame.

Figure 2:
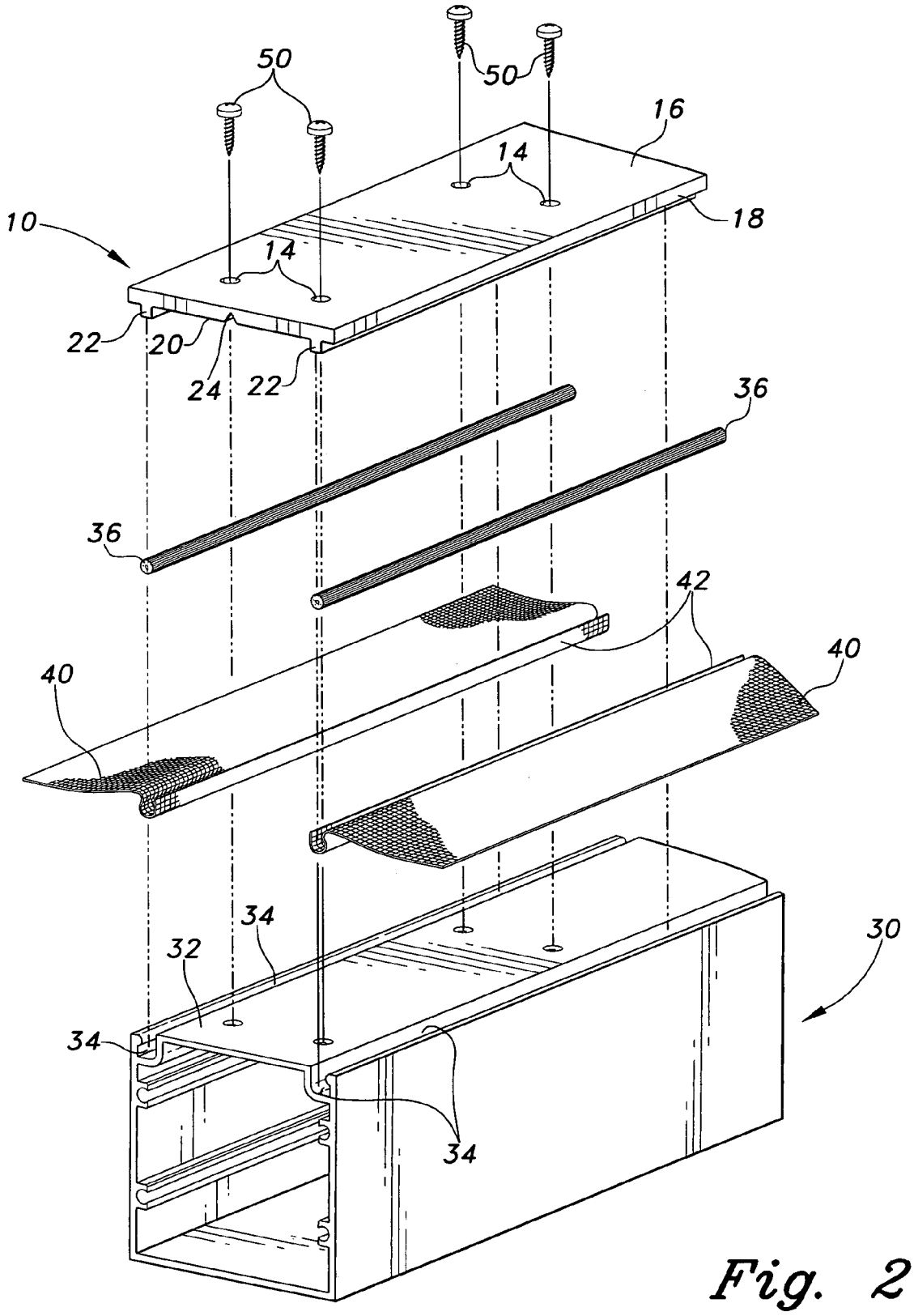
FIG. 2 is an exploded environmental perspective view of the screen frame reinforcement member according to the present invention in position for attachment to a screen frame member.
Figure 3:
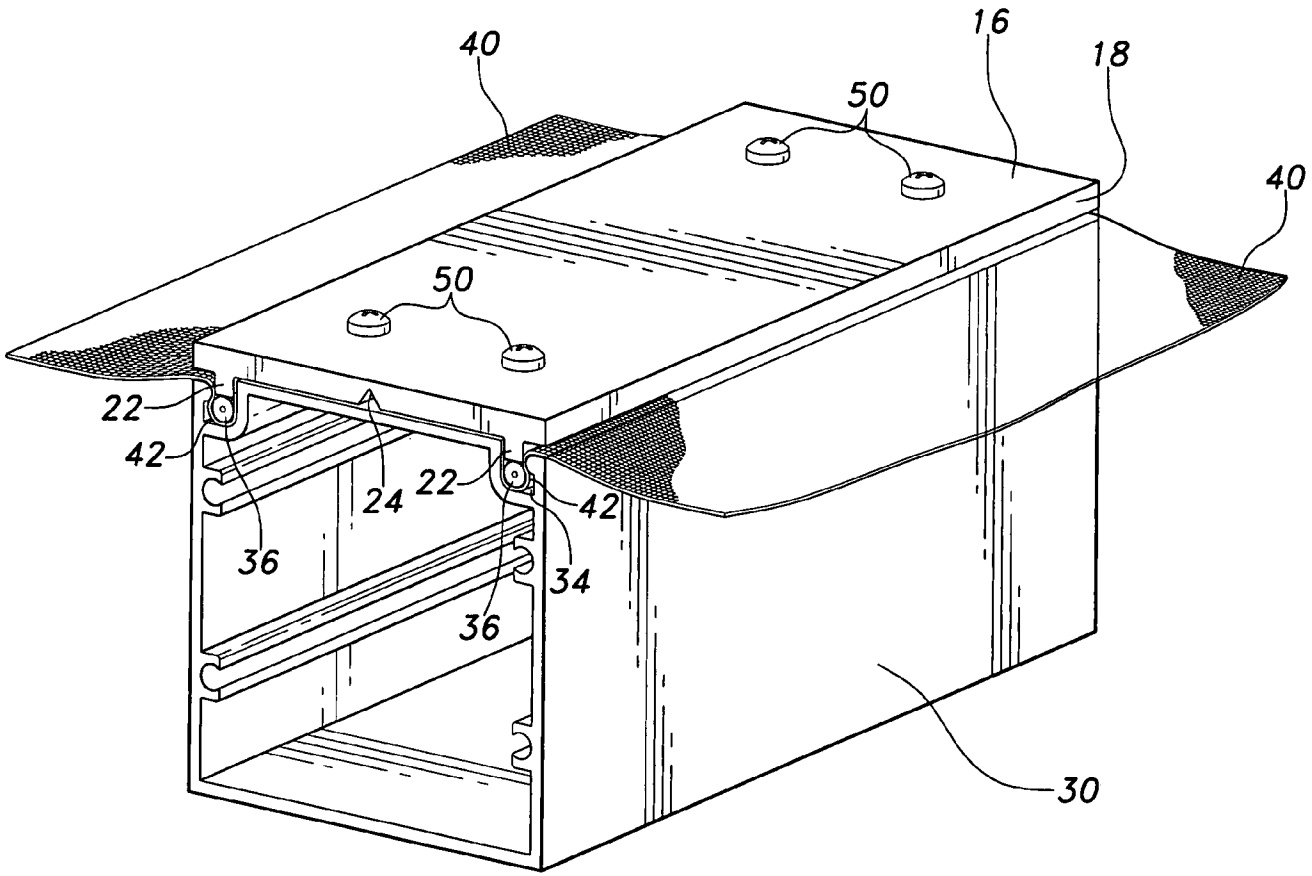
FIG. 3 is an environmental perspective view of the screen frame reinforcement member according to the present invention showing attachment of two screen edges to a frame member.

FIG. 2 shows an exploded perspective view of how a reinforcement member 10 would fit over a frame member 30 in use. FIG. 3 shows a perspective view of a completed reinforcement member 10 and frame 30 assembly (the length of the reinforcement member 10 and frame member 30 are not drawn to scale in FIG. 3, being shortened to show a complete assembly). The reinforcement member 10 has a uniform cross-sectional shape, with the exception of predrilled screw holes 14. The reinforcement member 10 is an elongated plate or strip with a substantially planar upper surface 16, two side edges 18, and a lower surface 20. Two substantially identical elongated protruding ridges 22 depend from the lower surface 20 adjacent the edges 18 of the plate and extend the entire length of the plate. An elongated central V-shaped groove 24 is defined in the lower surface and extends the entire length of the plate. The reinforcement member 10 is preferably about 2 inches wide.

A conventional screen frame member 30 is made from square aluminum tubing, having an outer face 32 with spline receiving grooves 34 extending longitudinally adjacent opposite edges of the outer face 32. A screen edge 42 is curved and placed into each spline receiving groove 34. In conventional screens, the screen edge 42 is retained in the groove 34 by compressing a flexible, resilient spline 36 into the groove 34, thereby clamping the screen edge 42 between the spline 36 and the frame member 30. With long continued exposure to the weather, however, the spline can become dislodged from the groove 34, a problem the present reinforcement member 10 obviates.

The protruding ridges 22 of the reinforcement member 10 are shaped and positioned to fit within the spline receiving grooves 34 of the attachment face 32 of a frame member 30. The ridges 22 run along the entire length of the reinforcement member 10. The spacing and width of the ridges 22 may vary for conventional screen framing of different arrangements, but the ridges 22 are generally spaced between about ⅛ inch and about ¼ inch away from the nearest side edge 18. The ridges 22 have a generally rectangular shape and usually protrude from the lower surface 20 by about ⅛ of an inch. The ridges 22 are preferably about ⅛ of an inch thick.

The central V-shaped groove 24 is provided to allow an installer to easily snap the reinforcement member 10 in half to yield two half-reinforcement members 12 that may be used to reinforce frame members 30 that have only one screen edge 42 attached to the frame member 30.

Self-tapping screws 50 fit into predrilled holes 14 in the reinforcement member 10 and are screwed into the outer face 32 of the frame member 30. Two side by side predrilled holes 14 are provided every sixteen inches along the length of the reinforcement member 10. Each predrilled hole 14 is about half way between a ridge 22 and the central V-shaped groove 24. When the reinforcement member 10 is split in half along the central groove for attachment to a frame member 30 at a terminal end of the screen 40, the reinforcement member 10 is attached to the frame member 30 by a single column of screws 50 spaced apart every sixteen inches.

The reinforcement member 10 is preferably provided in stock pieces of ten feet in length, allowing for easy handling, although the length of the reinforcement member 10 is not critical. Frame members 30 are usually provided in stock lengths of twenty feet.

Figure 4A:
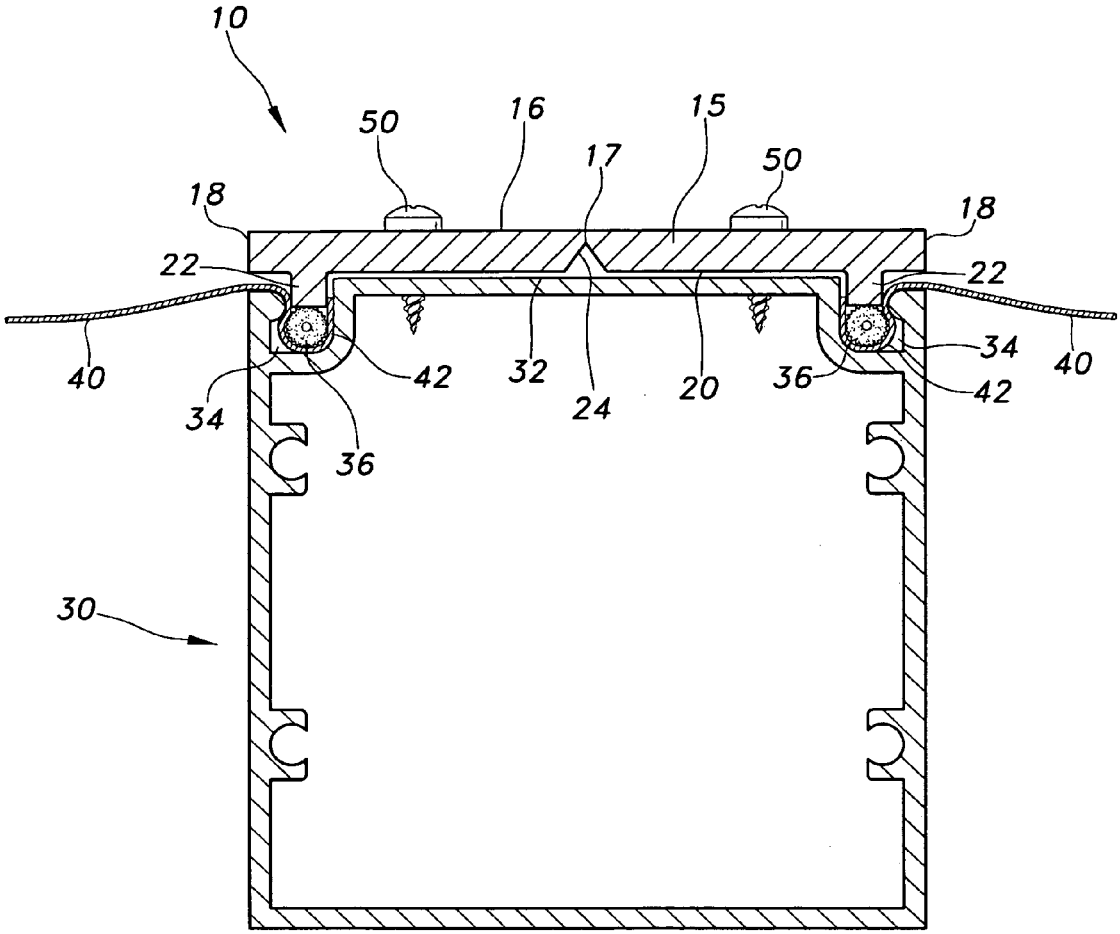
FIG. 4A is a section view of a first embodiment of a screen frame reinforcement member according to the present invention attached to a first type of screen frame member.

FIG. 4A shows a cross section of a first embodiment of the screen frame reinforcement member 10 attached to a first frame member 30 using a generally circular spline 36. The ridges 22 of the first embodiment are spaced between about ⅛ of an inch away from the nearest side edge 18. The ridges 22 preferably protrude from the lower surface 20 by ⅛ of an inch. The ridges 22 are preferably about ⅛ of an inch thick. The plate or main body 15 of the reinforcement member 10 is preferably between about ⅛ of an inch thick. The V-shaped groove 24 reduces the thickness of the center portion 17 of the reinforcement member 10 to less than half of the thickness of the main portion 15 of the reinforcement member 10. More particularly, the center portion 17 is preferably about one-fourth of the thickness of the main portion 15, e.g., about 1/32 of an inch thick for a 1/8" thick plate 15. The V-shaped groove 24 is preferably between about 1/8 of an inch to about 1/4 of an inch wide and about 3/32 of an inch deep for a 1/8" thick plate 15.

Figure 4B:
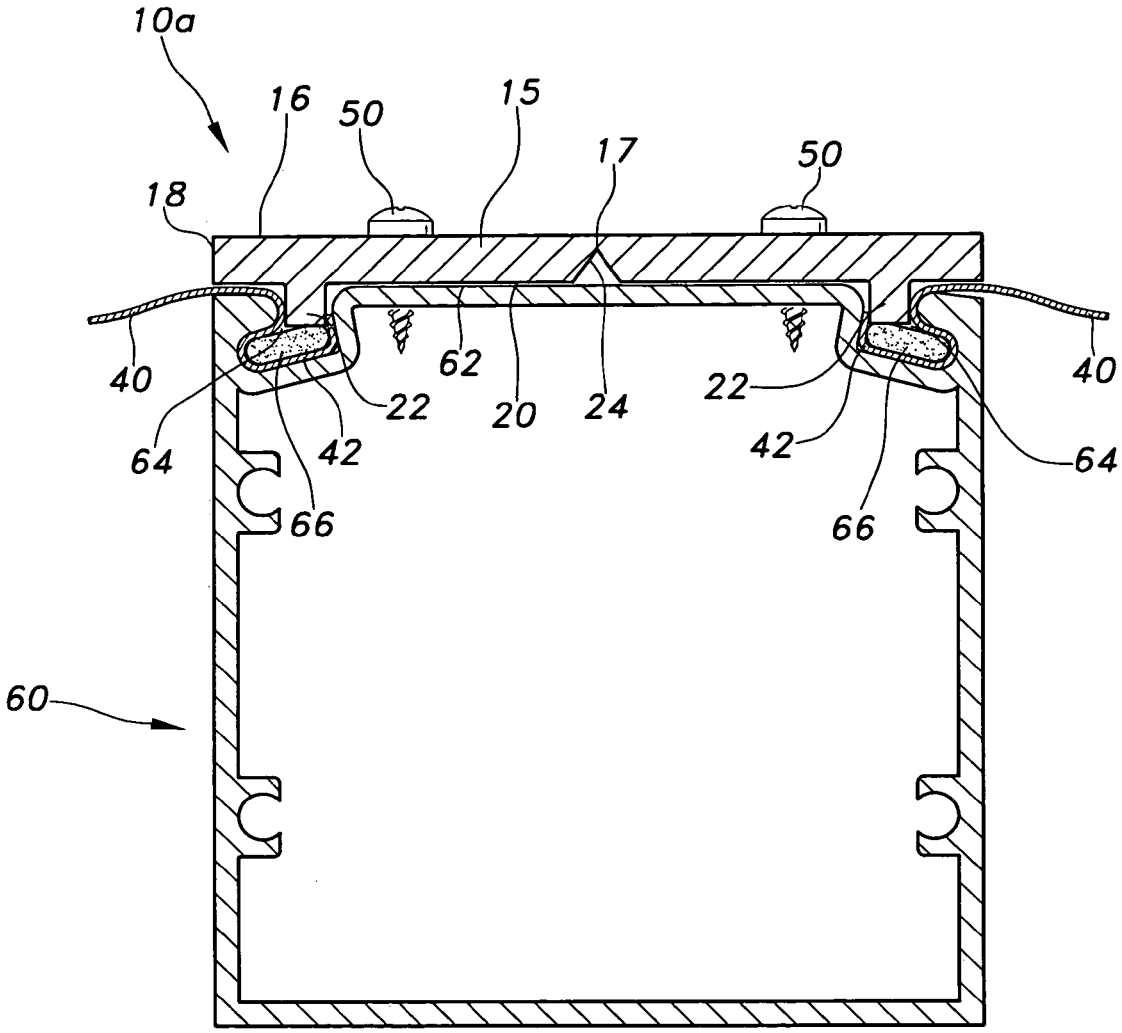
FIG. 4B is a section view of a second embodiment of a screen frame reinforcement member according to the present invention attached to a second type of screen frame member.

FIG. 4B shows a cross section of a second embodiment of the screen frame reinforcement member 10*a* attached to a screen frame member 60 having a different spline 66 and spline receiving groove 64 shape. The outer face 62 of frame member 60 is adapted for receiving a generally flattened and broadened spline 66, rather than a cylindrical spline 36, and therefore requires a reinforcement member 10 with differently spaced ridges. The ridges 22 of the reinforcement member 10 of FIG. 4B are spaced about 3/16 of an inch away from the nearest side edge 18. In all other respects, reinforcement member 10*a* is identical to reinforcement member 10.

It is to be understood that the relative measurements of the parts of the reinforcement member may be adjusted to fit screen frame members of different dimensions, such that the protruding ridges 22 fit into the spline receiving grooves 34 of the frame member 30.

It is to be understood that the present invention is not limited to the embodiments described above, but encompasses any and all embodiments within the scope of the following claims.

I claim:

1. A screen frame reinforcement member, comprising:

a flat, elongated plate having a substantially planar upper surface, a substantially planar lower surface, and two opposing side edges;

at least one elongated ridge protruding from the lower surface adjacent one of the side edges and extending the length of said plate, said plate being adapted for attachment to an outer face of a screen frame member; and a plurality of fasteners for attaching said plate to the outer face of the screen frame member;

wherein said ridge is dimensioned and configured for insertion into a spline receiving groove of the screen frame member in order to retain a spline in the groove;

whereby reinforcing the clamping of a screen between the spline and the screen frame member.

2. The screen frame reinforcement member according to claim 1, wherein said plate has anodized exterior surfaces for a decorative, corrosion-resistant finish.

3. The screen frame reinforcement member according to claim 1, wherein said plate is made from aluminum.

4. The screen frame reinforcement member according to claim 1, wherein said plate has a plurality of predrilled screw holes defined therein spaced apart along said plate for attaching said plate to the screen frame member.

5. The screen frame reinforcement member according to claim 1, wherein said at least one ridge is spaced from at least one of the side edges by between about 1/8 and 1/4 inches.

6. The screen frame reinforcement member according to claim 1, wherein said at least one ridge protrudes from the lower surface by about 1/8 of an inch.

7. The screen frame reinforcement member according to claim 1, wherein said at least one ridge has a generally rectangular shape in transverse section.

8. The screen frame reinforcement member according to claim 1, said at least one ridge consists of a first ridge and a second ridge disposed adjacent the respective side edges of said plate for attachment to a screen frame member securing two screen edges.

9. The screen frame reinforcement member according to claim 8, wherein said plate has an elongated central V-shaped groove extending the length of said plate, wherein said plate is used intact on a frame member securing two screen edges and is frangible along the V-shaped groove for attachment of one-half the plate to a frame member securing a single screen edge.

10. In combination, a screen frame and a screen frame reinforcement member comprising:

a screen;

a spline;

a frame having a rectangular tubular construction with a plurality of spline receiving grooves defined around an inner periphery of said frame;

wherein an edge of said screen is disposed in said plurality of spline receiving grooves, and said spline is seated in said plurality of spline receiving grooves for retaining the edge of said screen;

a flat, elongated plate having a substantially planar upper surface, a substantially planar lower surface, and two opposing side edges, said plate having an elongated V-shaped groove defined along a longitudinal center of said plate, said plate being frangible along said V-shaped groove; and an elongated ridge protruding from said lower surface adjacent each of said side edges and extending the length of said plate, said plate being adapted for attachment to an outer face of frame and said ridges being dimensioned and configured for insertion into said spline receiving grooves in order to retain said splines in said grooves, thereby clamping said screen between said splines and said frame.

11. The combination according to claim 10, wherein said plate is made from aluminum.

12. The combination according to claim 10, wherein said plate has an anodized upper surface.

13. The combination according to claim 10, wherein said plate has a plurality of predrilled screw holes defined therein adapted for attaching said plate to said screen frame member.

14. A method for reinforcing the attachment of a screen to a screen frame, comprising the steps of:

inserting an edge of the screen into a groove defined in a screen frame member;

pressing a resilient spline into the groove over the edge of the screen;

attaching a reinforcement member to the screen frame member over the groove in order to retain the spline and the screen edge in the groove;

wherein the reinforcement member includes a substantially rigid plate having a ridge protruding from a lower surface thereof;

aligning the ridge with the spline; and at least partially pressing the ridge into the groove so that the ridge bears against the spline.

15. The method according to claim 14, wherein said attaching step further comprises fastening the reinforcement member to the screen frame member with self-tapping screws.

* * * * *